US009793625B2

(12) United States Patent
Warashina

(10) Patent No.: US 9,793,625 B2
(45) Date of Patent: Oct. 17, 2017

(54) ELECTRIC WIRE WITH CONNECTING TERMINAL AND METHOD FOR MANUFACTURING SUCH ELECTRIC WIRE

(71) Applicant: YAZAKI CORPORATION, Tokyo (JP)

(72) Inventor: Shinya Warashina, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/066,986

(22) Filed: Mar. 10, 2016

(65) Prior Publication Data

US 2016/0276758 A1 Sep. 22, 2016

(30) Foreign Application Priority Data

Mar. 19, 2015 (JP) ..... 2015-056394
Mar. 19, 2015 (JP) ..... 2015-056534

(51) Int. Cl.

*H01R 11/12* (2006.01)
*H01R 43/28* (2006.01)
*H01R 4/34* (2006.01)
*H01R 11/11* (2006.01)

(52) U.S. Cl.

CPC ..... *H01R 11/12* (2013.01); *H01R 43/28* (2013.01); *H01R 4/34* (2013.01); *H01R 11/11* (2013.01)

(58) Field of Classification Search

CPC .... H01R 11/12; H01R 43/28; H01R 33/7621; H01R 43/052; H01R 11/281; H01R 11/282

USPC ..... 174/74 R, 128.1, 128.2; 439/889

See application file for complete search history.

(56) References Cited

U.S. PATENT DOCUMENTS 825,748 A * 7/1906 Muhlstephan ..... D07B 1/02 57/211
1,751,405 A * 3/1930 Herman ..... H01R 11/12 29/461
2,157,007 A * 5/1939 Offner ..... H01R 4/16 439/868
2,971,321 A * 2/1961 Himmelfarb ..... D07B 1/02 57/237
5,695,110 A * 12/1997 Schirmer ..... H01R 43/0256 228/173.5

(Continued)

FOREIGN PATENT DOCUMENTS

JP 2000-57855 A 2/2000

*Primary Examiner* — Harshad Patel
(74) *Attorney, Agent, or Firm* — Kenealy Vaidya LLP

(57) ABSTRACT

An electric wire with a connecting terminal and a method for manufacturing the electric wire are provided. The electric wire has a plurality of wire conductors and an insulation cover that covers the wire conductors. The plurality of wire conductors includes the connecting terminal to be connected to a counterpart component at an end of the electric wire at which the plurality of wire conductors is stripped of the insulation cover. The connecting terminal has a first portion of the plurality of wire conductors, a second portion of the plurality of wire conductors folded back on top of the first portion, the first portion and the second portion being welded to each other, and a through hole extending through the connecting terminal at a location where the first portion and the second portion are welded to each other.

9 Claims, 9 Drawing Sheets

(56) References Cited

U.S. PATENT DOCUMENTS

| | | | | |
|---|---|---|---|---|
| 6,452,101 | B1 * | 9/2002 | Haramaki | B23K 11/115 174/128.1 |
| 6,641,444 | B2 * | 11/2003 | Hanazaki | H01R 11/11 439/877 |
| 8,556,650 | B2 * | 10/2013 | Ikeda | H01R 13/567 439/456 |
| 8,692,120 | B2 * | 4/2014 | Debladis | H01B 7/1825 174/128.2 |
| 8,921,696 | B2 * | 12/2014 | Otsuka | H01R 4/021 174/74 R |
| 2005/0082083 | A1 * | 4/2005 | Nolan | A01K 3/005 174/128.2 |
| 2009/0315419 | A1 * | 12/2009 | Mita | H01R 4/20 310/71 |
| 2013/0180778 | A1 * | 7/2013 | Yamamoto | H01R 4/5041 174/74 R |

* cited by examiner

ELECTRIC WIRE WITH CONNECTING TERMINAL AND METHOD FOR MANUFACTURING SUCH ELECTRIC WIRE

CROSS-REFERENCE TO RELATED APPLICATIONS

The present application claims priority from Japanese Patent Application Nos. 2015-056394 and 2015-056534 both filed on Mar. 19, 2015, the entire contents of which are incorporated herein by reference.

FIELD OF INVENTION

The present invention relates to an electric wire for connection and a method for manufacturing the electric wire. More particularly, the invention relates to the electric wire provided with a connecting terminal formed at a plurality of wire conductors stripped of an insulation cover at an end of the electric wire, and a method for manufacturing the electric wire.

RELATED ART

Generally, a wire harness which is formed by bundling a plurality of electric wires is mounted on a vehicle such as a motor car. In the electric wire of this type, a plurality of wire conductors are stripped of an insulation cover at an end of the electric wire, and a terminal metal fitting to be connected to a counter terminal is press-fitted to the stripped wire conductors.

However, the terminal metal fitting which is press-fitted to the end of the electric wire has a pair of barrel pieces which are crimped so as to enclose the end of the electric wire. Therefore, in case of the electric wire having a large diameter such as a high voltage cable, components become large-sized, incurring an increase of cost for the components, and the number of steps in the press-fitting work is also increased.

In view of the above, according to a method in the related art, a rotary brush which is rotating is pressed against a plurality of wire conductors stripped of the insulation cover at the end of the electric wire, thereby to entangle the wire conductors irregularly and disorderly to be formed into a dumpling-like shape. Thereafter, by molding the wire conductors in the dumpling-like shape with a press, the electric wire provided with a connecting terminal having a hole is produced. According to this method, because the connecting terminal can be formed integrally at the end of the electric wire, it is unnecessary to prepare the terminal metal fitting separately, and the cost for the components can be reduced (see, e.g., JP2000-57855A).

In the above described related art, it is possible to irregularly entangle the wire conductors with one another by pressing the rotary brush, in case where the wire conductors are relatively thin. However, in case where the wire conductors are relatively thick like the high voltage cable, it is impossible to irregularly entangle the wire conductors with one another, because the respective wire conductors have high strength.

SUMMARY

Illustrative aspects of the present invention provide an electric wire with a connecting terminal which can be formed by a simple method, irrespective of a thickness of wire conductors, and the method for manufacturing the electric wire.

By applying resistance welding to a plurality of wire conductors stripped of the insulation cover and extended in parallel with each other, surfaces of the adjacent wire conductors are welded to each other, and the wire conductors can be unified.

However, in case where the wire conductors extended in parallel with each other are welded to each other, as described above, it is concerned that on occasion of conducting a boring work, there may occur a shortage of strength in a longitudinal direction of the wire conductors and in a direction intersecting this direction, and separation (coming apart) of the wire conductors from each other may occur.

According to an illustrative aspect of the present invention, an electric wire has a plurality of wire conductors and an insulation cover that covers the wire conductors. The plurality of wire conductors includes the connecting terminal to be connected to a counterpart component at an end of the electric wire at which the plurality of wire conductors is stripped of the insulation cover. The connecting terminal has a first portion of the plurality of wire conductors, a second portion of the plurality of wire conductors folded back on top of the first portion, the first portion and the second portion being welded to each other, and a through hole extending through the connecting terminal at a location where the first portion and the second portion are welded to each other.

According to another illustrative aspect of the present invention, a method for manufacturing the electric wire described above is provided. The method includes folding back the second portion on top of the first portion, welding the first portion and the folded back second portion to each other, and forming, after the welding, a hole through the connecting terminal at a location where the first portion and the second portion are welded to each other.

Other aspects and advantages of the invention will be apparent from the following description, the drawings and the claims.

DETAILED DESCRIPTION

Figure 1:
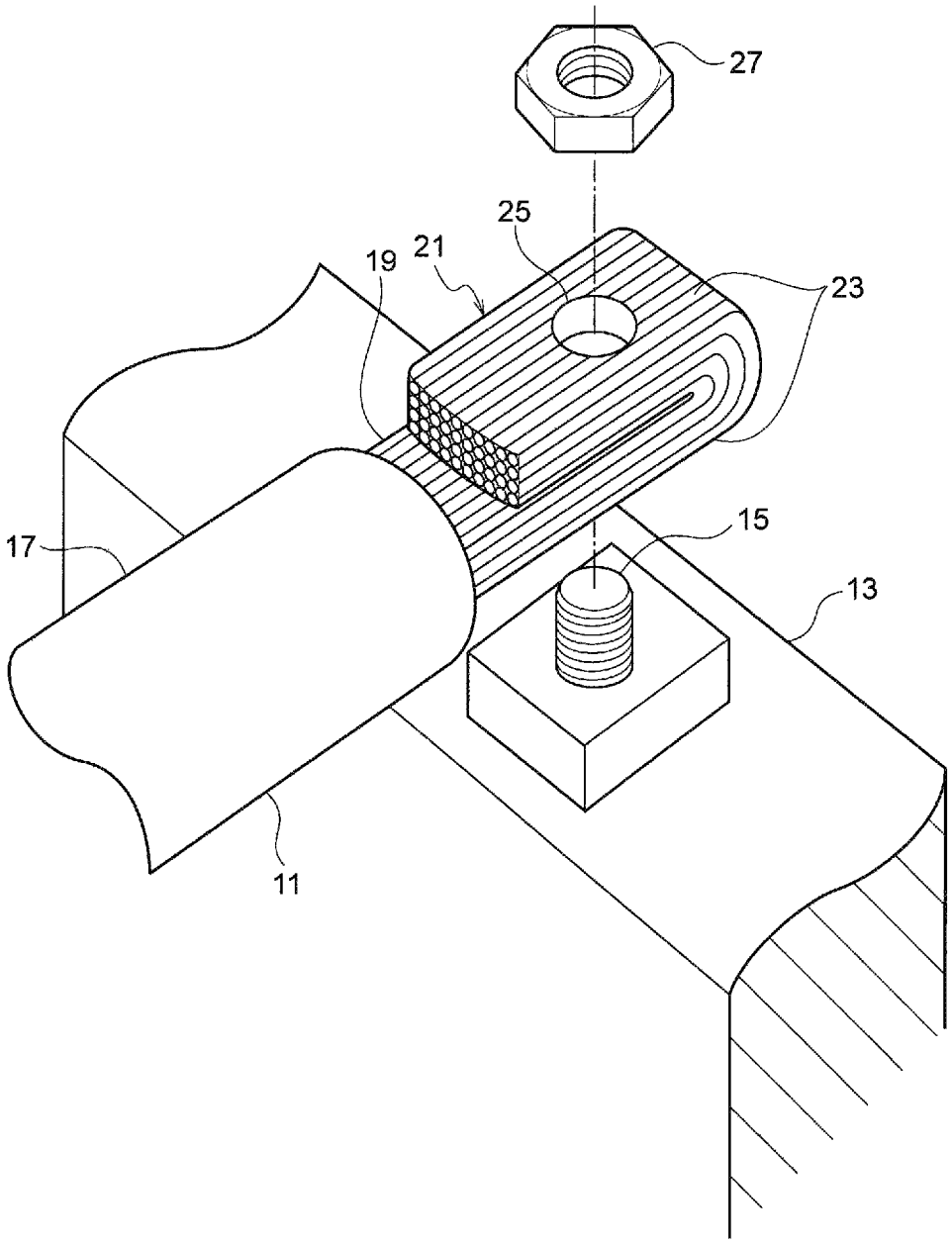
FIG. 1 is a perspective view of an electric wire with a connecting terminal according to an exemplary embodiment of the present invention.

Hereinafter, exemplary embodiments of the present invention will be described in detail with reference to the drawings. An electric wire 11 with a connecting terminal according to an exemplary embodiment is used, for example, as the wire for composing a wire harness which is mounted on an electric car, a hybrid car and so on, and arranged between electric appliances such as a battery, an inverter, a motor. However, the invention is not limited to the case, but can be applied to electric wires of various types. FIG. 1 shows an example where the electric wire 11 is connected to a counterpart component 15 which is mounted on an electric appliance 13 at a counter side.

The electric wire 11 is formed in a round shape in cross section, as shown in FIG. 1, and provided with an insulation cover 17 formed of resin so as to cover a plurality of wire conductors 19. At an end portion of the electric wire 11, the insulation cover 17 is removed to expose a plurality of wire conductors.

In the electric wire 11 in this exemplary embodiment, each of the wire conductors 19 is formed in a shape of twisted wires, which is obtained by twisting a number of metallic raw wires of copper alloy in a spiral shape. However, the wire conductor 19 need not be necessarily formed in a shape of the twisted wires.

A connecting terminal 21 is provided at the end portion of the electric wire 11 as a rectangular block of the stripped wire conductors 19. This connecting terminal 21 is configured to electrically and mechanically connect the electric wire 11 to the counterpart component 15. The connecting terminal 21 has a first portion of the plurality of stripped wire conductors 19 and a second portion of the plurality of stripped wire conductors 19 folded back on top of the first portion, and the first portion and the second portion are welded to each other. End faces 23 of a plurality of wire conductors at both sides in a superposed direction are respectively formed as substantially flat faces.

A through hole 25 having a round shape in cross section and passing though a plurality of wire conductors 19 in the superposed direction is formed in a center part of the connecting terminal 21. The connecting terminal 21 is fixed to the counterpart component 15, by inserting the counterpart component 15 into this through hole 25, and by tightening it with a nut 27.

Figure 2:
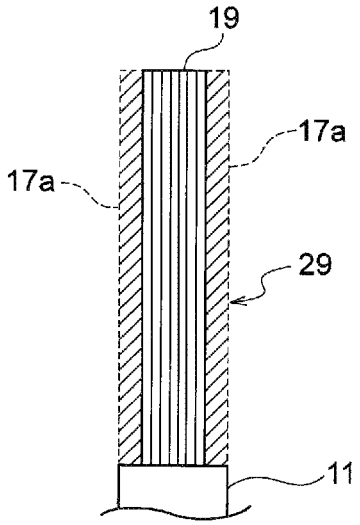
FIG. 2 is a view illustrating a step of removing an insulation cover from an end of the electric wire.

The electric wire 11 in this exemplary embodiment can be produced by the following method, for example. As a first step, an insulation cover 17*a* in an end portion 29 of the electric wire 11 is peeled off, as shown in FIG. 2, thereby to expose the wire conductors 19. On this occasion, attention must be paid so that the wire conductors 19 may not be broken nor separated, and the sheath may not be left.

Then, a plurality of wire conductors 19 stripped of the insulation cover 17 are preformed. More specifically, a portion of the plurality of wire conductors 19 is folded back on top of the other portion of the wire conductors 19. In this exemplary embodiment, the wire conductors 19 are arranged such that tip ends of the wire conductors 19 that are folded back may be positioned forward than a distal end of the insulation cover 17.

Figure 3:
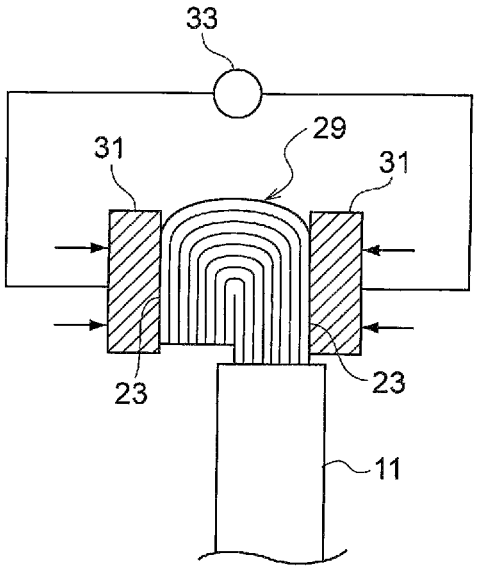
FIG. 3 is a view illustrating a step of welding stripped wire conductors at the end of the electric wire.

Then, as shown in FIG. 3, a plurality of wire conductors 19 of the electric wire 11 which have been folded back are subjected to welding treatment by a resistance welding method. In the resistance welding method, a plurality of wire conductors 19 which are superposed on each other are clamped between a pair of electrodes 31 in a shape of a flat plate, and a power supply 33 is inputted to flow an electric current between the electrodes 31, while pressurizing the wire conductors 19 (in directions of arrow marks). In this manner, the wire conductors 19 are heated by the electric current which is flowing, and welding occurs between the adjacent wire conductors 19. As the results, the wire conductors 19 on a plane where they are superposed are welded to each other, and hence, a plurality of wire conductors 19 and a plurality of wire conductors 19 which have been folded back are bonded to each other to be integrated into a block-like shape. Moreover, the both end faces 23 which are in contact with the electrodes 31 are made substantially flat, following the flat faces of the electrodes.

In the resistance welding method, an energizing time is usually a few seconds. However, provided that a current value is constant, for example, in case where the energizing time is too short, a shortage of a binding force between the wire conductors 19 occurs, and in case where the energizing time is too long, excessive welding occurs, and discoloration happens, in some cases. Therefore, conditions for treatment such as the current value, the energizing time, and so on, should be appropriately determined according to a thickness or so of the wire conductors 19 of the electric wire 11, within a range not generating a shortage of the strength after welding.

For the purpose of welding the wire conductors 19, a desired welding method may be adopted according to material for the wire conductors 19. In this exemplary embodiment, the resistance welding method is adopted, because the wire conductors 19 are formed of copper or copper alloy. However, in case where the wire conductors 19 are formed of aluminum or aluminum alloy, an ultrasonic welding method or the like is favorable.

Figure 4:
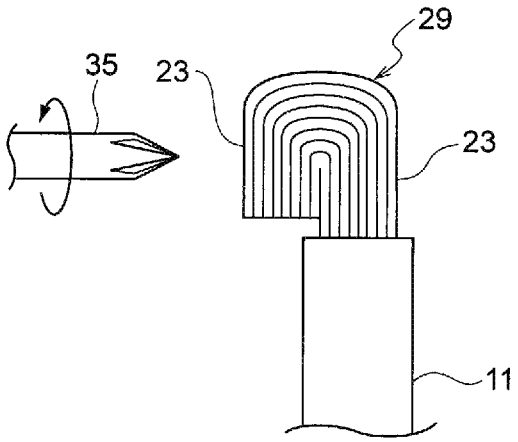
FIG. 4 is a view illustrating a step of making a hole in the stripped wire conductors at the end of the electric wire.
Figure 5A:
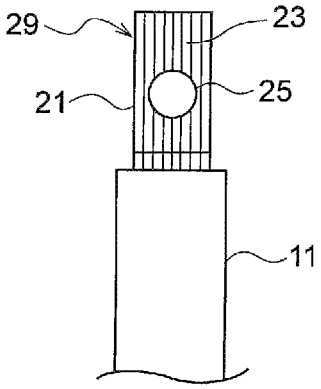
FIG. 5A is a front view of the connecting terminal in which a through hole is formed.
Figure 5B:
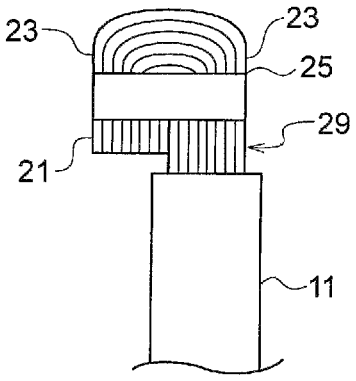
FIG. 5B is a sectional view of the connecting terminal in which the through hole is formed.

Then, a hole is formed through the end portion 29 where the wire conductors 19 are welded as a block. In this boring work, the through hole 25 is formed in a direction in which the folded back portion of the plurality of wire conductors 19 is placed on top of the other portion of the plurality of wire conductors 19. Specifically, the through hole 25 is formed so as to pass through the both end faces 23 of the end portion 29. In this boring work, a drill press or the like is used, and the work is conducted by fixing the end portion 29 with a jig or the like. By pushing a drill 35 having a pointed tip end into the end faces 23, while rotating, as shown in FIG. 4, the though hole 25 having a round shape is formed in a center part in a lateral direction of the end portion 29, as shown in FIG. 5. After the boring work is finished, burrs or the like which are erected from a peripheral edge of the through hole 25 are removed.

When the electric wire 11 with the connecting terminal in this exemplary embodiment is connected to the counterpart component 15, the counterpart component 15 is inserted into the through hole 25 of the connecting terminal 21, and tightened with the nut 27, as described above. On occasion of tightening the counterpart component 15 with the nut 27, it is preferable to use a torque wrench or the like. In this manner, it is possible to avoid the connecting terminal 21 from being subjected to an excessive stress.

As described herein above, according to this exemplary embodiment, the connecting terminal 21 is formed through the two processes, namely, the process for folding back a plurality of wire conductors 19 which are exposed from the insulation cover 17, and the process for welding a plurality of wire conductors which are folded back and superposed on each other. Either of the two processes can be conducted with a simple installation, irrespective of a size of the wire conductor 19 such as a wire diameter, and can be easily automated. Therefore, according to this exemplary embodiment, it is possible to form the connecting terminal 21 easily and at a low cost, even in case where the wire conductors 19 have a relatively large wire diameter like the high voltage cable.

Moreover, in this exemplary embodiment, a plurality of wire conductors 19 stripped of the insulation cover 17 are folded back and welded. As the results, it is possible to allow the folded back part of the wire conductors 19 to have the high strength. In addition, as compared with a case where the wire conductors 19 are welded together without being folded back, a cross-sectional area in a direction intersecting the longitudinal direction of the wire conductors 19 (a direction where the adjacent wire conductors 19 are welded to each other) is increased to a substantially double, thereby to improve a binding force between the wire conductors 19. In this manner, the strength of the end portion 29 can be improved, and so, it is possible to restrain removal of the wire conductors 19 from each other, when the boring work is conducted.

Moreover, it is desirable that the both end faces 23 where the through hole 25 is formed have a predetermined flatness, for the purpose of securing a desired workability and a boring accuracy. Because the both end faces 23 in this exemplary embodiment are the faces with which the electrodes 31 are brought into contact in the welding process, the predetermined flatness is secured following the faces of the electrodes. Therefore, by providing the through hole 25 in the direction where a plurality of wire conductors 19 are superposed on each other, it is possible to conduct the boring work, without applying the flattening treatment such as grinding to the both end faces 23, and hence, simplification of the manufacturing process can be achieved.

Next, electric wires with connecting terminals according to other exemplary embodiments of the present invention will be described. In the following exemplary embodiments, descriptions of the features that are common to those of the above described exemplary embodiment are omitted, and only the features that are different from those of the above described exemplary embodiment will be described.

Figure 6:
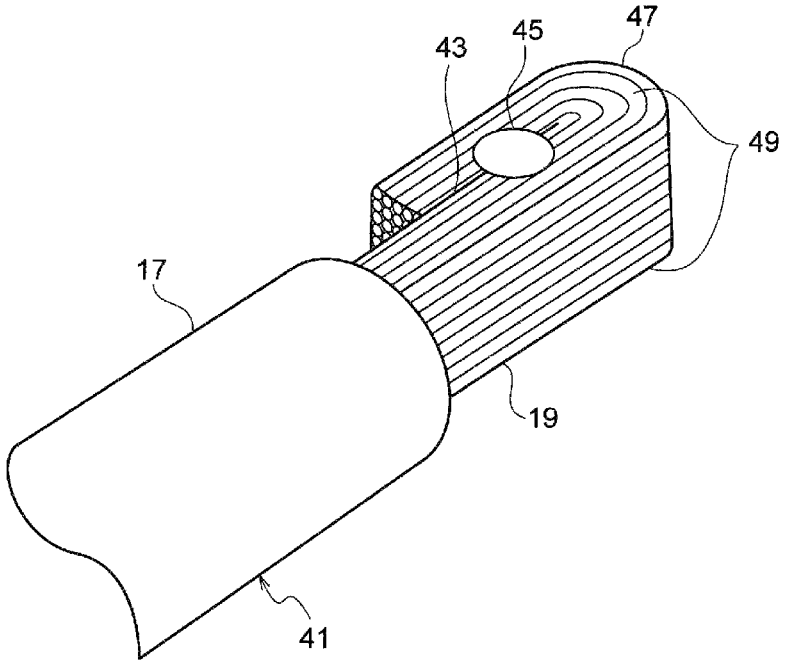
FIG. 6 is a perspective view of an electric wire with a connecting terminal according to another exemplary embodiment of the invention.

In the exemplary embodiment as shown in FIG. 6, the electric wire 11 has a through hole 45 extending along an interface 43 between a first portion of the plurality of wire conductors 19 and a second portion of the plurality of wire conductors 19 folded back on top of the first portion.

According to this exemplary embodiment, the through hole 45 is provided along a direction where folded back parts 47 of the respective wire conductors 19 are superposed (a vertical direction in FIG. 6). Therefore, it is possible to advantageously utilize a high strength of the folded back parts 47. Accordingly, removal of the wire conductors 19 from each other on occasion of conducting the boring work can be effectively restrained. However, in this exemplary embodiment, both end faces 49 where the through hole 45 is formed are not brought into contact with the electrodes 31 in the welding process, and so, some flattening treatment must be applied to the both end faces 49 for the purpose of securing flatness.

Figure 7:
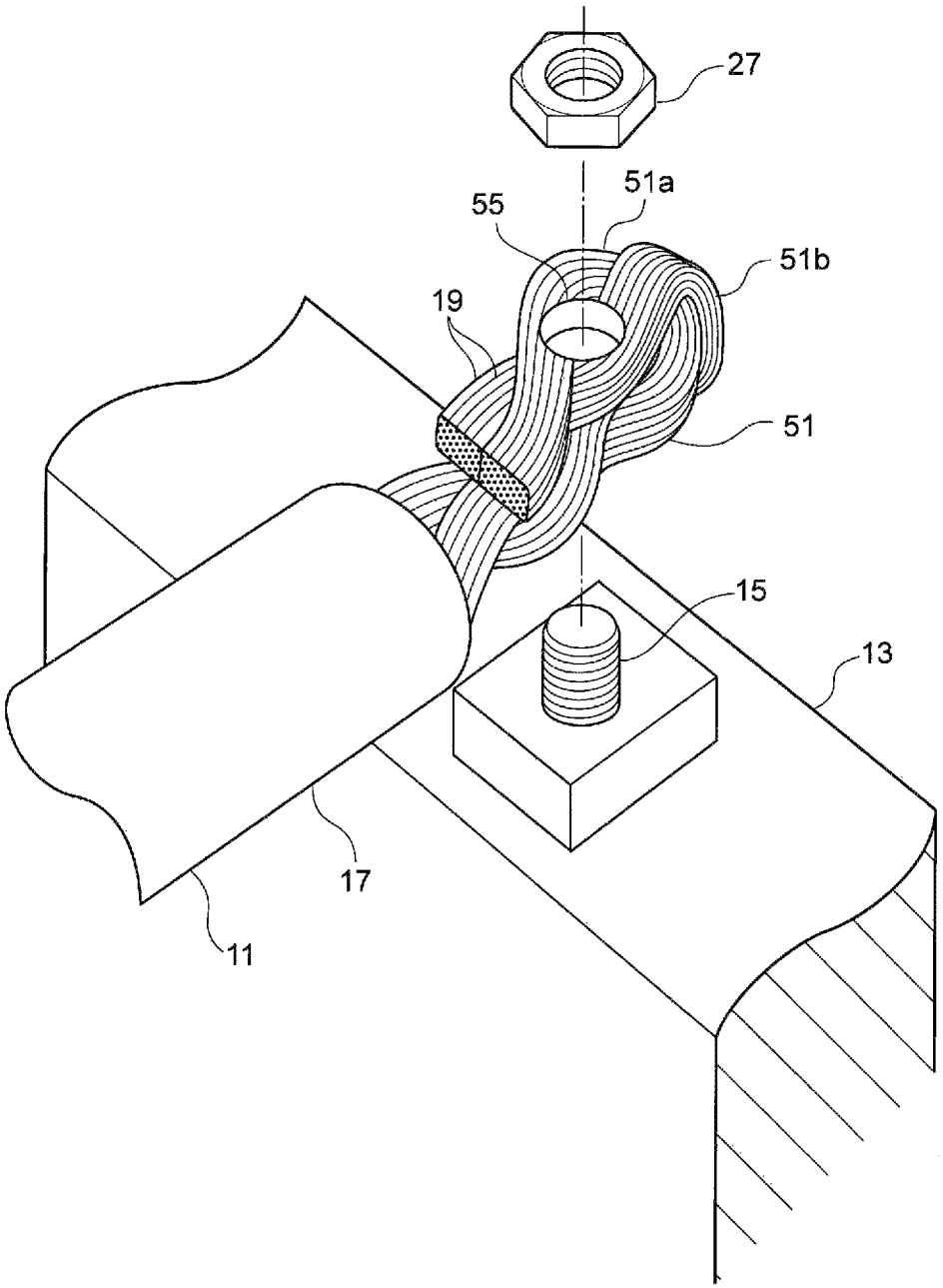
FIG. 7 is a perspective view of an electric wire with a connecting terminal according to another exemplary embodiment of the invention.

In the electric wire 11 in an exemplary embodiment as shown in FIG. 7, a plurality of wire conductors 19 stripped of the insulation cover 17 are divided into a plurality of entwined bundles. Specifically, in a connecting terminal 51 formed at an end portion of the electric wire 11, two bundles of the wire conductors 19 are folded back in a state in which they are twisted with each other, and are welded in a superposed state.

Figure 8:
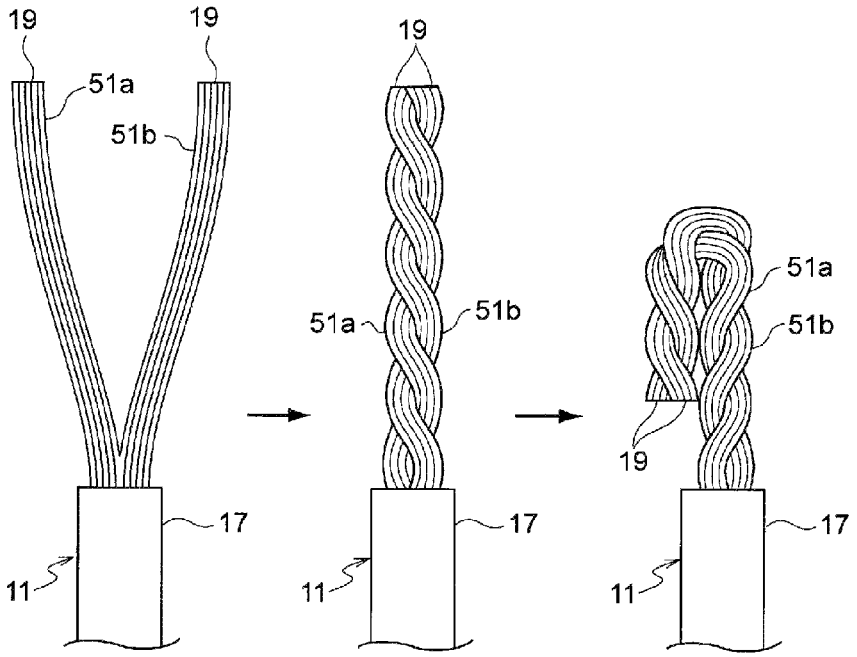
FIG. 8 illustrates steps of dividing a plurality of wire conductors stripped of an insulation cover into two bundles, twisting the bundles, and folding back the twisted bundles.

For example, as shown in FIG. 8, a plurality of wire conductors 19 which are exposed from the insulation cover 17 are divided into two bundles 51*a*, 51*b* having substantially the same amount, and then, these two bundles 51*a*, 51*b* are repeatedly twisted together to form a single bundle. Thereafter, the single bundle is folded back.

In this case too, the twisted bundles 51*a*, 51*b* are pressurized in a direction where they are superposed (a lateral direction in FIG. 8) in the welding process. In short, the vertical direction in FIG. 7 is the pressurizing direction.

Figure 9:
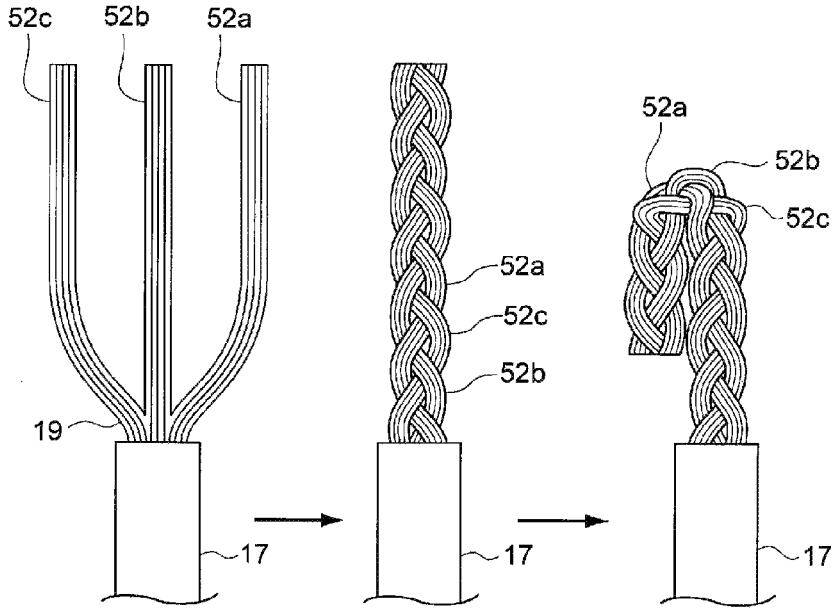
FIG. 9 illustrates steps of dividing a plurality of wire conductors stripped of an insulation cover into three bundles, braiding the bundles, and folding back the braided bundles.

As shown in FIG. 9, a plurality of wire conductors 19 which are exposed from the insulation cover 17 may be divided into three bundles 52*a*, 52*b*, 52*c*, and these bundles 52*a*, 52*b*, 52*c* may be braided together in a braid-like shape to form a single bundle. Thereafter, the single bundle may be folded back. In this case too, the wire conductors 19 which are folded back are subjected to the welding treatment in the same manner.

According to this exemplary embodiment, all the wire conductors 19 which are exposed are only divided into a plurality of bundles, and these bundles are simply twisted or braided by a plurality of times along the longitudinal direction of the wire conductors 19. Therefore, it is possible to entwine the wire conductors 19 through simple works, irrespective of a size of the wire conductor 19 such as a wire diameter. Such works can be automated, for example, by attaching tip ends portions of the respective bundles to arms, and by rotating the arms around the longitudinal direction of the wire conductors 19.

Moreover, in case where the entwined bundles of wire conductors 19 are welded, as described above, a higher strength can be obtained in a region where the bundles are entwined and crossed than in a region where they are not crossed. Therefore, it is possible to improve the strength of the end portion 29, and removal of the wire conductors 19 from each other on occasion of conducting the boring work can be further restrained.

By braiding the bundles 52*a*, 52*b*, 52*c* of the wire conductors 19, as in the exemplary embodiment in FIG. 9, it is possible to increase the number of the regions where the wire conductors 19 are entwined and crossed, as compared with a case where the wire conductors 19 are divided into the two twisted bundles. Accordingly, the strength of the end portion 29 can be further improved, and removal of the wire conductors 19 from each other on occasion of conducting the boring work can be more effectively restrained.

It is also possible to divide the wire conductors 19 into four or more bundles, and to braid them together by a predetermined method. In this manner, the strength of the end portion 29 after the welding can be further improved.

Also in this exemplary embodiment, a through hole 55 may be provided along an interface between a first portion of the entwined bundles of wire conductors 19 and a second portion of the entwined bundles of wire conductors 19 that are folded back. In this manner, it is possible to advantageously utilize the strength of the folded back parts, in the same manner as in the exemplary embodiment in FIG. 6.

Figure 10:
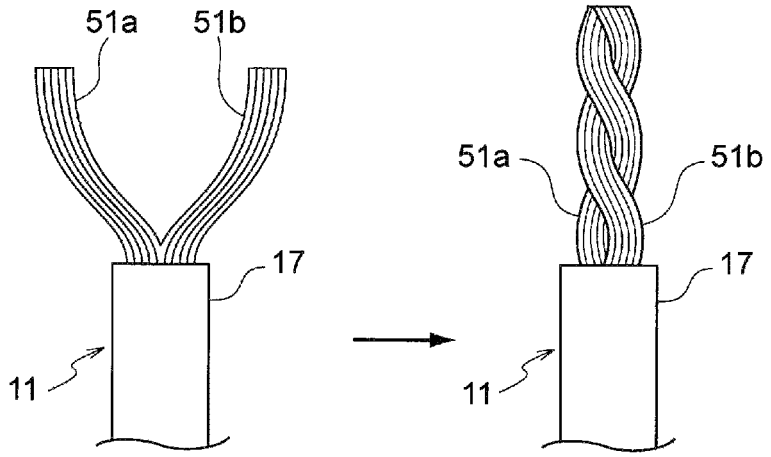
FIG. 10 illustrates steps of dividing a plurality of wire conductors stripped of the insulation cover into the two bundles and twisting the bundles.
Figure 11:
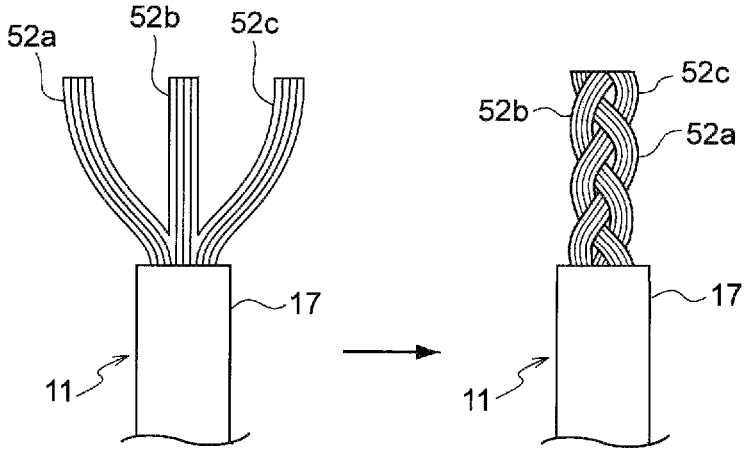
FIG. 11 illustrates steps of dividing a plurality of wire conductors stripped of the insulation cover into the three bundles and braiding the bundles.
Figure 12:
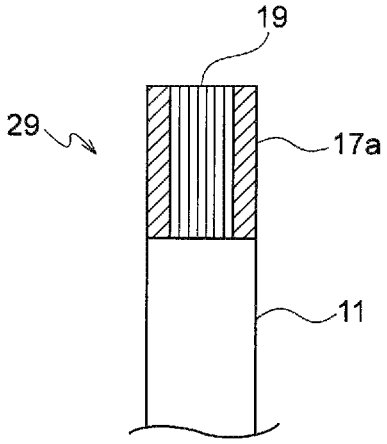
FIG. 12 is a view illustrating a step of removing the insulation cover from the end of the electric wire.

Moreover, on occasion of performing the wire conductors 19, in case where the wire conductors 19 are divided into a plurality of entwined bundles, it is also possible to remove the insulation cover 17 rather shortly as shown in FIG. 12, and to apply the welding treatment in a state in which the bundles are entwined without folding back the wire conductors 19 (see FIGS. 10 and 11).

Figure 13:
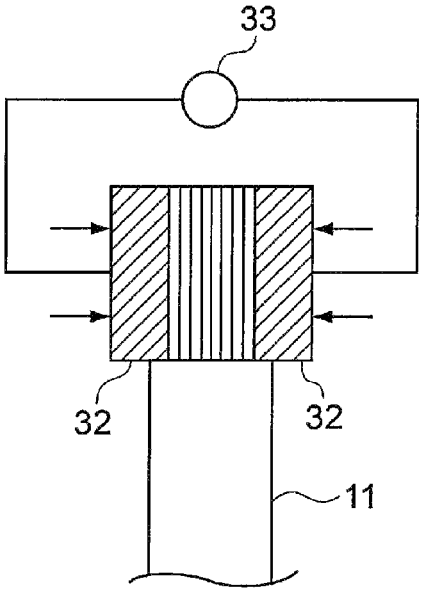
FIG. 13 is a view illustrating a step of welding the stripped wire conductors at the end of the electric wire.
Figure 14:
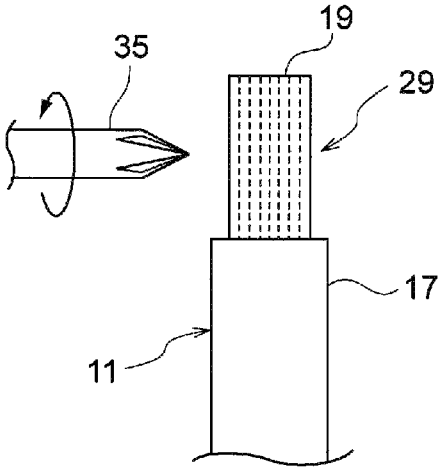
FIG. 14 is a view illustrating a step of making a hole in the stripped wire conductors at the end of the electric wire.
Figure 15A:
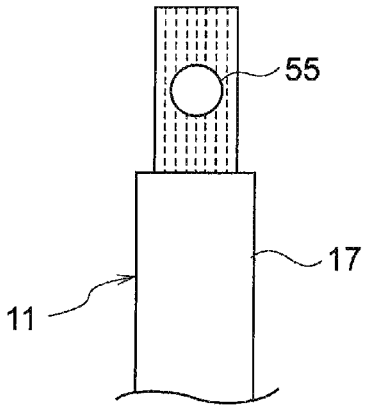
FIG. 15A is a front view of the connecting terminal in which the through hole is formed.
Figure 15B:
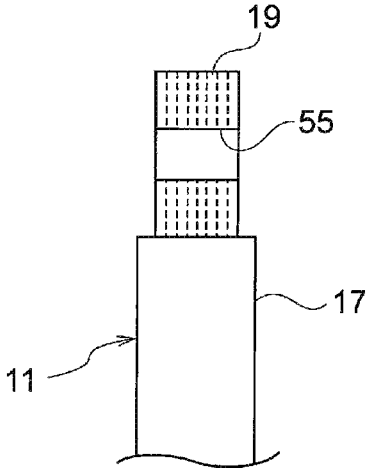
FIG. 15B is a sectional view of the connecting terminal in which the through hole is formed.

The wire conductors 19 which have been preformed in this manner are clamped between a pair of electrodes 32 in a shape of a flat plate, as shown in FIG. 13, and subjected to the welding treatment by the resistance welding method. Then, by pushing a drill 35 having a pointed tip end, while rotating, as shown in FIG. 14, the through hole 55 having a round shape is formed in a center part of the end portion 29 in the lateral direction, as shown in FIGS. 15A and 15B. These welding treatment and boring work are carried out in the same manner as in the cases in FIGS. 3 to 5B.

While the present invention has been described with reference to certain exemplary embodiments thereof, the scope of the present invention is not limited to the exemplary embodiments described above, and it will be understood by those skilled in the art that various changes and modifications may be made therein without departing from the scope of the present invention as defined by the appended claims.

What is claimed is:

1. An electric wire comprising a plurality of wire conductors and an insulation cover that covers the wire conductors, the plurality of wire conductors comprising a connecting terminal to be connected to a counterpart component at an end of the electric wire at which the plurality of wire conductors is stripped of the insulation cover, wherein the connecting terminal comprises a first portion of the plurality of wire conductors, a second portion of the plurality of wire conductors folded back on top of the first portion, a weld connecting the first portion to the second portion, and a through hole extending through the weld.

2. The electric wire according to claim 1, wherein the through hole extends through an interface between the first portion and the second portion folded back on top of the first portion.

3. The electric wire according to claim 1, wherein the connecting terminal comprises a plurality of entwined bundles of wire conductors.

4. The electric wire according to claim 3, wherein the plurality of entwined bundles of wire conductors comprises two twisted bundles of wire conductors.

5. The electric wire according to claim 3, wherein the plurality of entwined bundles of wire conductors comprises three braided bundles of wire conductors.

6. The electric wire according to claim 3, wherein the plurality of entwined bundles of wire conductors includes the first portion and the second portion folded back on top of the first portion.

7. The electric wire according to claim 1, wherein the through hole extends through the first portion and the second portion of the plurality of wires.

8. The electric wire according to claim 1, wherein the through hole extends through the weld in a direction that the second portion of the plurality of wire conductors is folded back on top of the first portion.

9. The electric wire according to claim 1, wherein the through hole extends through the weld orthogonal to a direction that the second portion of the plurality of wire conductors is folded back on top of the first portion.

* * * * *